US005211135A

United States Patent [19]

Correia et al.

[11] Patent Number: 5,211,135

[45] Date of Patent: May 18, 1993

[54] APPARATUS AND METHOD OF DESLAGGING A BOILER WITH AN EXPLOSIVE BLASTWAVE AND KINETIC ENERGY

[76] Inventors: Paul A. Correia, 11805 S. 33rd St., Bellevue, Nebr. 68005; Robert R. Lamotte, 905 Shenandoah Dr., Papillion, Nebr. 68046

[21] Appl. No.: 872,541

[22] Filed: Apr. 23, 1992

[51] Int. Cl.[5] ..... F28G 7/00

[52] U.S. Cl. ..... 122/379; 165/84; 165/85; 15/1

[58] Field of Search ..... 165/84, 95; 122/379; 15/1; 29/81.01, 81.02

[56] References Cited

U.S. PATENT DOCUMENTS 5,056,587 10/1991 Jones et al. ..... 165/1

*Primary Examiner*—Albert W. Davis, Jr.

*Attorney, Agent, or Firm*—John A. Beehner

[57] ABSTRACT

An apparatus for deslagging a steam boiler includes a plurality of loop clusters of detonating cord, each including a plurality of loops arranged in a multi-directional pattern to impart a three-dimensional generally spheroid shaped to the cluster The clusters are supported in spaced apart relation between a pair of adjacent tubing panels and are interconnected by lengths of detonating cord to form an explosive assembly adapted for substantially simultaneous detonation. A plurality of explosive assemblies are arranged in approximately every third or fourth spread between tubing panels and are interconnected so as to pyrotechnically detonate each explosive assembly after a predetermined delay in response to detonation of another explosive assembly to which it is connected. The invention is further directed to the method of deslagging a steam boiler with the plurality of loop clusters of the invention.

18 Claims, 5 Drawing Sheets

APPARATUS AND METHOD OF DESLAGGING A BOILER WITH AN EXPLOSIVE BLASTWAVE AND KINETIC ENERGY

BACKGROUND OF THE INVENTION

The present invention is directed generally to an apparatus and method for removal of ash and slag from steam generator tubing and more particularly to such an apparatus and method which utilizes an explosive blastwave and sandblast-like effect created by the detonation of high velocity detonating cord configured in multi-directional loop clusters and suspended between alternating banks of boiler tubing.

It is well known that in the operation of a steam generator, ash and slag build up on the tubes or heat transfer surfaces through the combustion of coal. As this ash and slag accumulates, a great deal of heat loss occurs which greatly impairs the efficiency of the boiler and its ability to produce electricity. Maintenance procedures designed to remove these deposits have met with mixed results. The techniques of manual shaking, hand rodding, high pressure water and shotgun blasting are still utilized in steam generators today. However, shortcomings such as risks to personnel and consumption of time have made these methods less appealing. It was not until the introduction of high explosive tube cleaning that adequate removal of ash and slag could be accomplished quickly while personnel were safely outside of the boiler.

High explosive deslagging is not without its drawbacks. A stick of dynamite, for example, used against hard slag may only clean a small percentage of one tube assembly. Several sticks of dynamite may not be linked together due to the massive overpressure that this would create within the boiler. In addition, boiler tube assemblies are spaced very close together in some areas and the tube wall construction is very thin and may not withstand a dynamite charge without damage.

High explosive detonating cord has been used for many years to remove one surface from another, thus the logical progression to detonating cord. Detonating cord such as Pentaerythrite Tetranitrate (PETN) is virtually the only commercial high explosive available that is packaged to allow detonation coverage of several square yards with the explosive weight of only a few sticks of dynamite.

One such method employing the use of detonating cord in a steam generator is described in the Halliburton/Jet Research Center, U.S. Pat. No. 5,056,587. This method relies on a sequential series of explosively induced tube vibrations to separate the ash and slag from boiler tubing. The procedure describes critical placement of the detonating cord in a substantially vertical position on each tubing panel immediately adjacent to the exterior surface of the tubes. It further suggests placement of said cord a distance of about twelve inches from tube spacers to avoid dissipation of explosive energy.

Vibrational cleaning methods are problematic due to the fact that boiler tube hangers and spacers add a great deal of rigidity to each assembly. When ash and slag deposits build up between the tubes, this bridging of ash greatly exacerbates the problem. Vertical hanging tubes that normally swing freely are often anchored at the bottom in a bed of ash, and tube assemblies with several feet of individual tubes often appear as a solid wall of ash. Since tube spacers and hangers protrude from the tube assemblies, they are usually one of the first places where ash deposits are likely to form and must be cleaned as well.

Accordingly, a primary object of the invention is to provide an improved apparatus and method of deslagging a boiler from utilizing an explosive blastwave and kinetic energy.

Another object of the invention is to efficiently remove substantially all of the ash from steam generator tubing with explosives and without damage to the tubing.

Another object of the invention is to create a high explosive blastwave in all directions to remove ash and slag from steam generator tubing.

Another object of the invention is to effectively harness the kinetic energy imparted by an explosive blastwave to further remove ash from adjacent steam generator tubing.

Another object of the invention is to provide an apparatus and method of deslagging a boiler with a minimum number of personnel and without danger to said personnel.

Another object of the invention is to provide an improved apparatus and method of deslagging a boiler which effectively removes ash and slag from tube hangers and spacers as well as from the boiler tubes themselves.

Another object of the invention is to provide an improved apparatus and method of deslagging a boiler without water so that clean up of dry ash and slag is facilitated.

Finally, a further object of the invention is to provide an improved apparatus and method of deslagging a boiler which are simple, efficient and economical.

SUMMARY OF THE INVENTION

The apparatus for deslagging a boiler with an explosive blastwave and kinetic energy according to the present invention includes a plurality of loop clusters of detonating cord, each loop clusters including a plurality of loops of detonating cord arranged in multi-directional pattern to impart a three-dimensional shape to each cluster. Lengths of detonating cord interconnect the plurality of loop clusters to form a first explosive assembly adapted for substantially simultaneous detonation of the loop clusters. The loop clusters of the first explosive assembly are arranged and supported in spaced apart relation between a pair of adjacent tubing panels.

To eliminate the need for reentry of personnel after detonation of each explosive assembly, it is preferred that multiple explosive assemblies be stalled in every second, third or fourth spread between adjacent tubing panels and that the explosive assemblies be interconnected in a manner to pyrotechnically detonate each explosive assembly after a predetermined delay in response to detonation of another explosive assembly.

The loop clusters are preferably formed in the general shape of a spheroid having a diameter slightly greater than the spacing between adjacent tubing panels so that the loop clusters may be frictionally supported at desired positions between tubing panels. The loop clusters may be formed on the job at the time of installation from a single length of detonating cord with the result that a plurality of loop clusters are interconnected in series for substantially simultaneous detonation. The loop clusters are preferably formed of low grain detonating cord on the order of 20 or 50 grain detonating cord. The number of loops in a clusters may vary but it is preferred that each loop cluster include between about 6 and 12 loops of detonating cord arranged in substantially varying directions to create an omni-directional blastwave upon detonation.

The principal of the invention is to remove ash and slag from the tubing panels contacted by the loop clusters as well as from the next adjacent tubing panels both by the explosive blastwave created upon detonation of the loop clusters as well as by the sand blast-like effect of the removed ash and slag striking adjacent tubing panels.

The invention furthermore contemplate an improved method for deslagging a steam boiler including steps of providing a plurality of loop clusters of detonating cord, interconnecting a plurality of loop clusters to form an explosive assembly, placing the loop clusters of an explosive assembly in spaced apart relation between adjacent tubing panels and detonating the explosive assembly. The method furthermore, contemplates forming a plurality of the explosive assemblies, arranging the loop clusters of each explosive assembly in spaced apart relation between a respective pair of adjacent tubing panels and placing the explosive assemblies in every second, third or fourth spread in a bank of boiler tubing.

DESCRIPTION OF A PREFERRED EMBODIMENT

Figure 1:
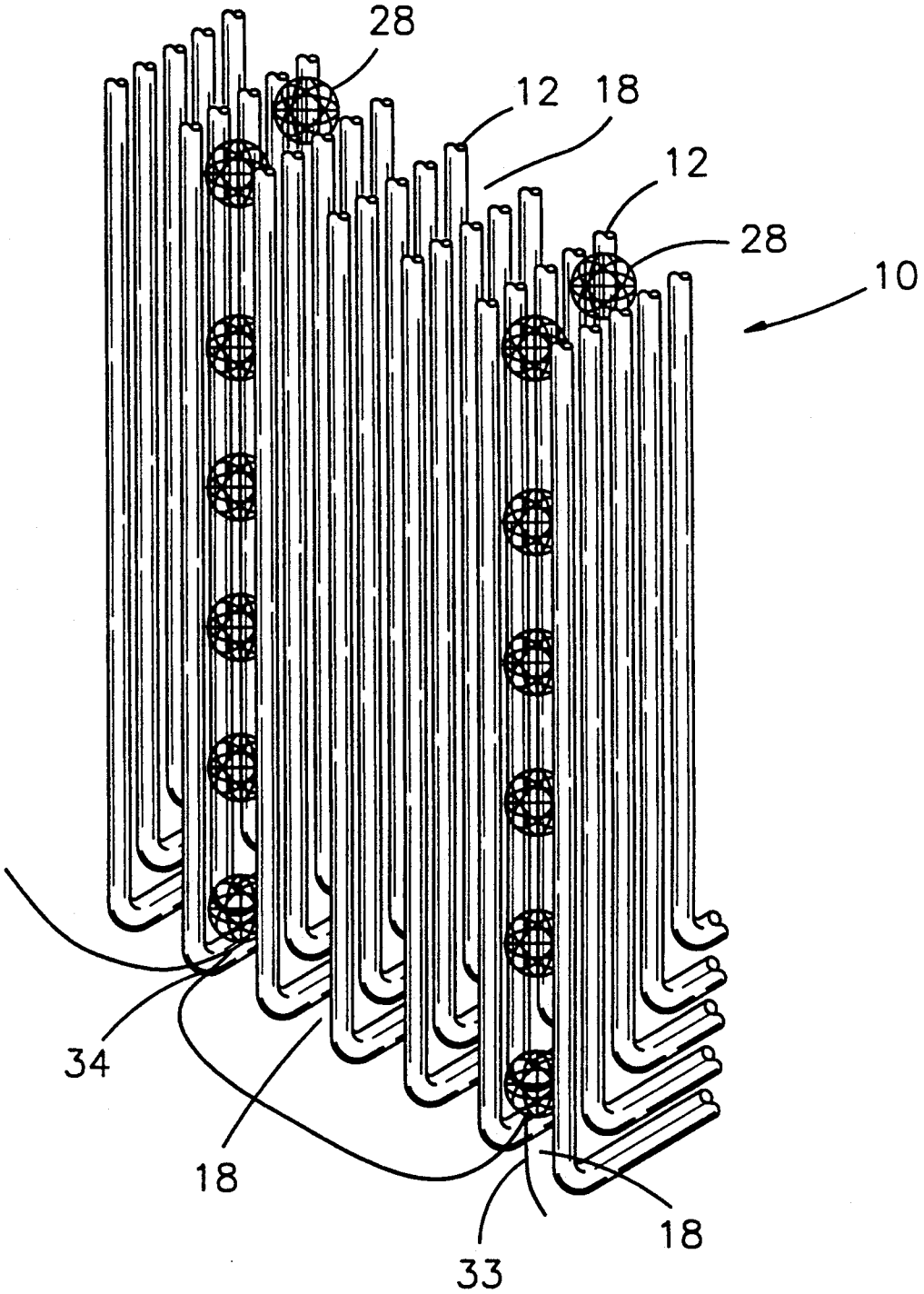
FIG. 1 is a partial foreshortened perspective view of a bank of boiler tubing panels including explosive assemblies of the present invention installed therein.

FIG. 1 illustrates a typical bank 10 of boiler tubing panels 12 as are commonly found in large commercial steam generators. A typical tubing panel 12 is diagrammatically illustrated in FIG. 4 and includes a plurality of spaced apart lengths of boiler tubing 14 connected by spacers 16 which may be metal bands or braces used to keep the tubes 14 in line and equally spaced apart. The individual tubes 14 and a panel 12 may be 40 foot long, for example, in a commercial steam generator which may include as many as 300 spreads 18, a term used to refer to the space between two tubing panels 12. Metal hangers or braces, not shown, are used to suspend or otherwise support the bank 10 of tubing in a steam generator.

Figure 2:
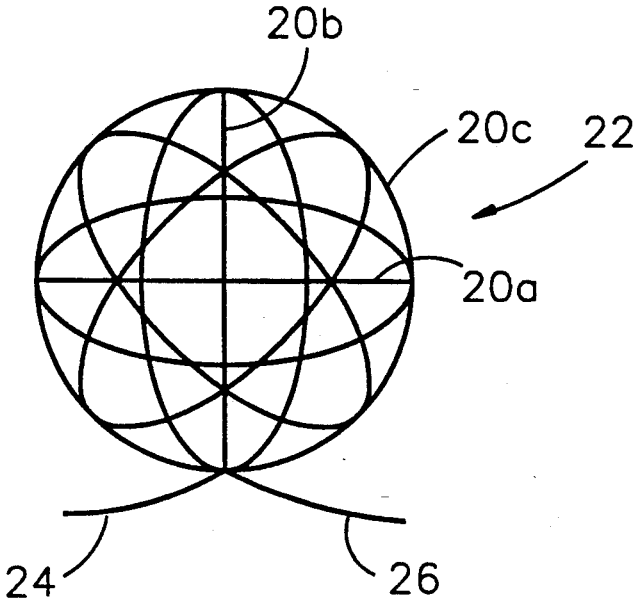
FIG. 2 is a generally ideal representation of a loop cluster of the invention.

The ash and slag buildup typically make each tubing panel 12 appear as a solid wall of rock. To remove the ash and slag, personnel referred to as blasters, are equipped with spools of low grain detonating cord and hand fashion a series of loops 20 into a loop cluster 22 as illustrated in FIG. 2 to produce a multi-directional explosive blastwave.

Figure 3:
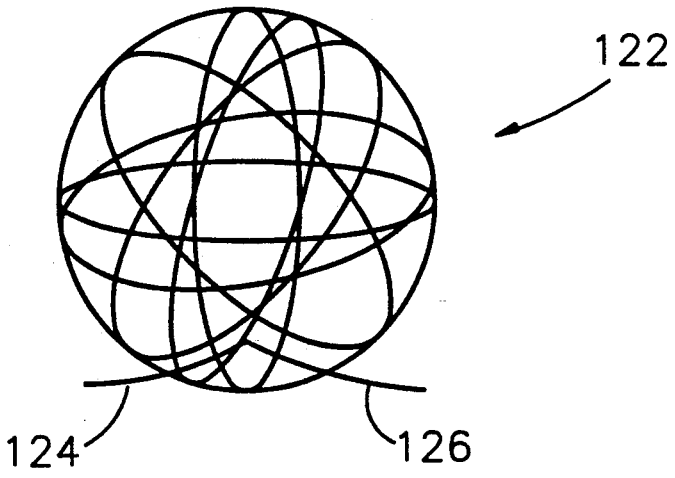
FIG. 3 is an alternate embodiment of loop cluster of the invention.

Each loop cluster 22 preferably includes between about 6 and 12 loops of the detonating cord, with each loop inclined relative to the others to collectively define somewhat of a spheroid shape. In a preferred loop cluster 22 of FIG. 2, a lead-in length of detonating cord 24 is formed into the loops 20 and then extends from the cluster 22 as at 26 to form another cluster 22 a predetermined distance from the first one. No two hand fashioned loop clusters are likely to be identical but a preferred loop cluster would include three loops indicated at 20*a*, 20*b* and 20*c* in FIG. 2 which has central axis disposed perpendicular to one another and additional sets of perpendicularly related loops inclined relative to the loops of the first group so that the loops are generally equally spaced about the periphery of the generally spheroid shape of the cluster 22. In reality, each loop cluster is more likely to have a somewhat haphazard arrangement as illustrated by cluster 122 in FIG. 3 wherein the lead-in cord 124 is formed into a series of loops inclined relative to one another before exiting at 126. All of the loops 120 are generally formed about the same center point to impart the generally spheroid shape to the loop cluster 22. Insert and embodiments, may be desirable to extend the loop cluster in one direction in a somewhat peanut-like shape or even more substantially in a hotdog-like shape but the truss spheroid shape is preferred. In all cases, it is important that the cluster be formed in a three-dimensional shape with individual loops facing all different directions to produce the multi-directional or omni-directional explosive blastwave of the invention.

Grain loading of the detonating cord is directly related to the size of the boiler, wall thickness of the tubing, and amount and hardness of the ash and slag encountered. Low grain detonating cord of a range between 7 and 70 grain, and more preferably 25 and 50 grain detonating cord is typically used to form the loop clusters. This is lower grain cord than that used in the method described in the Halliburton/Jet Research Center, Inc. process of U.S. Pat. No. 5,056,587, and the present invention would typically use ten-fold the length of detonating cord used in the Halliburton process for deslagging a given section of a steam generator.

Figure 5:
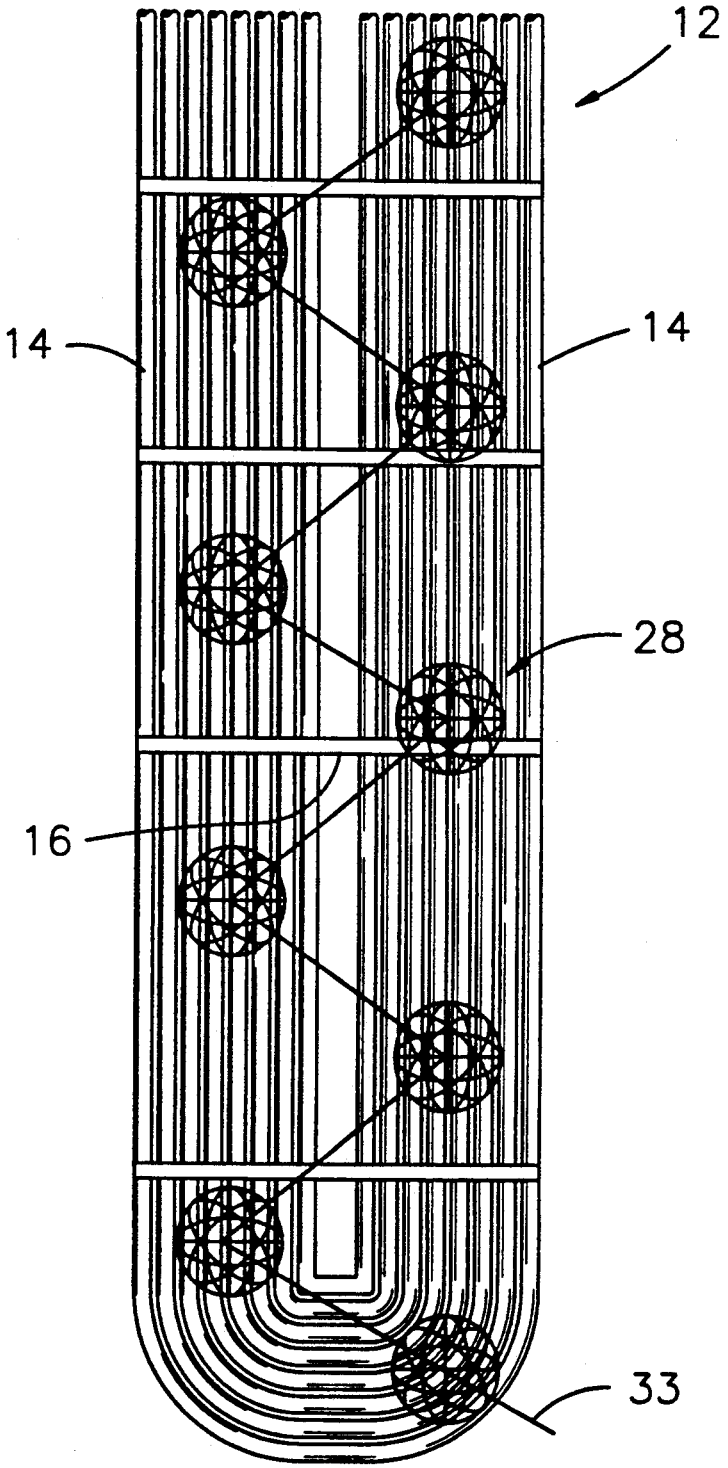
FIG. 5 is a diagrammatic view illustrating the arrangement of loop clusters of the invention relative to a boiler tubing panel.

Referring to FIGS. 1 and 5, a plurality of interconnected loop clusters 22 form a single explosive assembly 28 adapted for placement in a spread between a pair of adjacent tubing panels 12. The clusters 22 of each explosive assembly 28 are preferably spaced apart with longitudinally and transversely as illustrated in FIG. 5, but not necessarily as uniformly as indicated therein. The following factors are used for determining the preferred distances between loop clusters 22 of an explosive assembly 28 between a spread of steam generator tubing panels 12:

a. Location of major ash and slag deposits within a spread;
b. Minimum number of loop clusters necessary to obtain sufficient overlap of the blastwave;
c. Maximum number of loop arrays allowed with regard to over-pressure stress levels; and
d. Square footage of the area to be cleaned.

Whereas precise standards have not and perhaps cannot be determined for ideal placement of the loop clusters, those skilled in the art will be able to form and arrange the loop clusters for effective deslagging in any given spread upon consideration of the above factors. In regard to the amount of explosive cord detonated at one time, it should be noted that a completed explosive assembly 28 may only encompass a portion of a heavily slagged tubing panel 14. Segmental cleaning of a tube bank is an additional consideration of grain loading. Loop clusters 22 are strategically located to displace the greatest amount of ash and slag in a given area. It should be appreciated that the size and location of each loop cluster 22 is determined by the blaster. Heavily slagged areas may require on or more clusters, and areas free of ash buildup may be completely avoided. Each loop cluster 22 is secured or suspended in place by the use of a cable tie, wire, friction or other suitable means.

Figure 6:
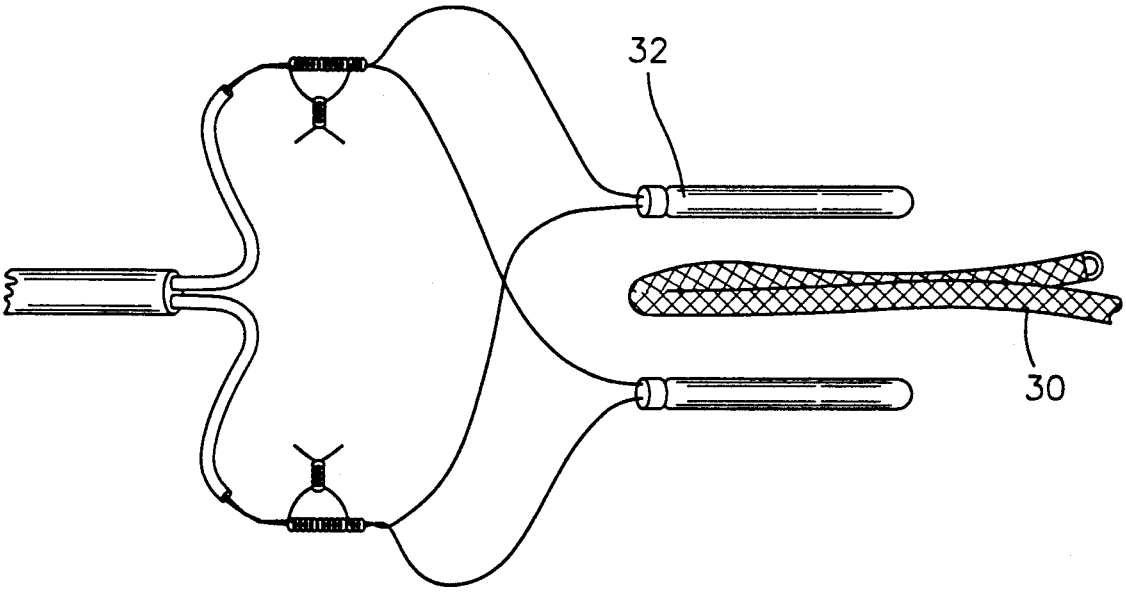
FIG. 6 is a diagrammatic illustration of the connection of an electric firing wire to a detonating cord with an electric blasting cap.

Each loop cluster within a tube spread 18 must be connected by explosive detonating cord so that upon blasting cap initiation, a simultaneous detonation of all loop clusters 22 will occur. The preferred method of connecting loop clusters is in series as illustrated in FIG. 5. Clusters 22 may be formed and secured in place from a continuous length of detonating cord 30 without the need to cut and splice connections. The completed explosive assembly is then ready for explosive initiation. A standard electrical blasting cap assembly 32, as illustrated in FIG. 6, is connected to the explosive assembly 28 at one end such as point 33 in FIG. 5 and detonated.

In the preferred embodiment, the explosive wave travels into the loop clusters creating a tornadic effect. This multi-directional blastwave, as it is referred to herein, effectively fragments the ash and propels it outward. As the ash and slag is channeled through the spaces between each individual tube, this sandblasting effect further fragments and propels the ash on adjacent tube assemblies through kinetic energy in a chain reaction that continues on until the working force of the blastwave is diminished, a distance of about 2 feet. The effect of this method lends credence to the kinetic theory of gasses. However, the invention makes no claim of proof of this theory.

Figure 4:
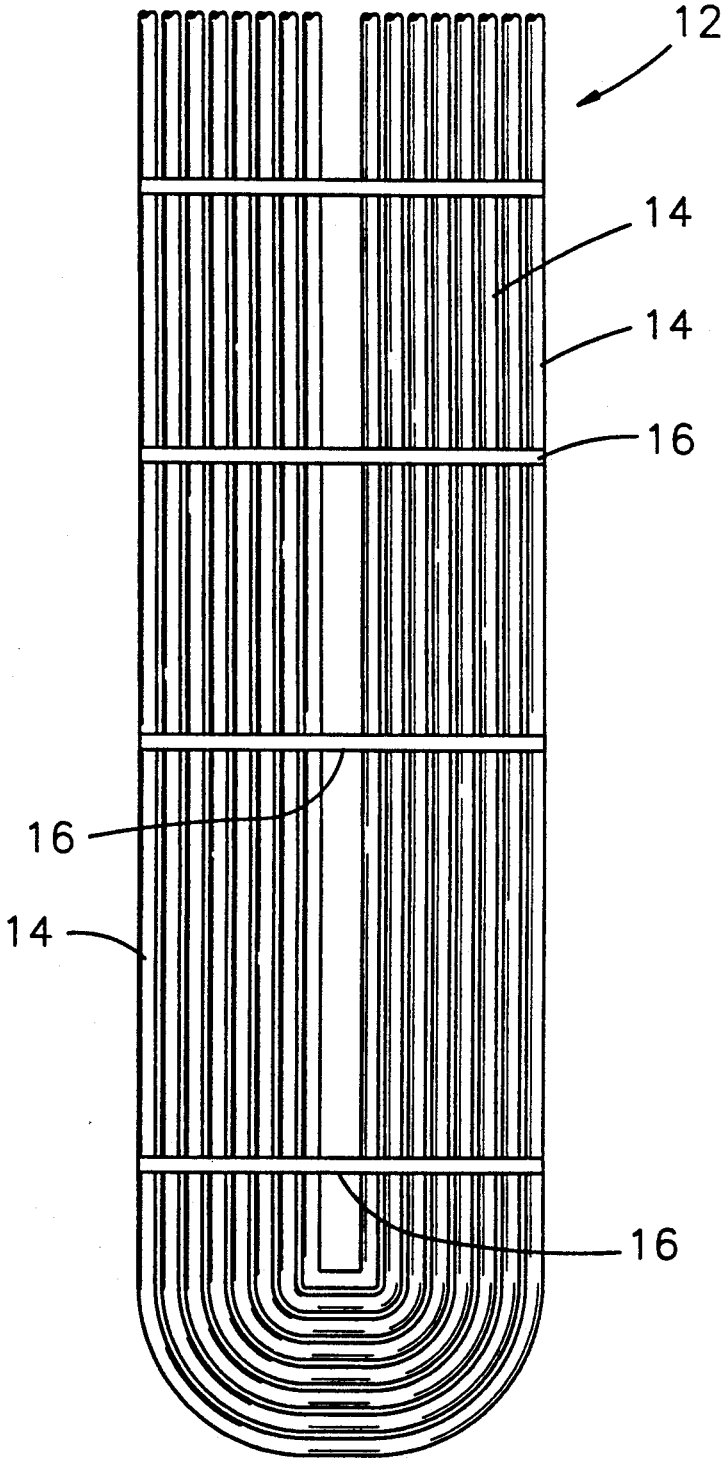
FIG. 4 is a front elevational view of a boiler tubing panel as is known in the prior art.

For deslagging an entire bank of tubing panels, explosive assemblies 28 are installed within the bank of tube assemblies (FIG. 4). The importance of spacing explosive assemblies in this phase of the invention is two-fold. First if the explosive assemblies were spaced too close together the explosive force can sometimes be great enough to set off another explosive assembly. This undesirable effect is known as sympathetic detonation. Secondly, the explosive assemblies must be separated by a distance no greater than the explosive blastwave can effectively clean. They should be at intervals of approximately 3 ½ feet. This usually equates to every third or fourth tube spread 18 and allows an overlap of opposing blastwaves.

Each explosive assembly is detonated separately and allowed to perform its cleaning task. However, within the confines of a boiler, controlled detonations create massive amounts of dust, smoke, and fumes, making it difficult for blasting crews to enter even after several minutes. In the preferred embodiment therefore, each explosive assembly 28 is connected in series by a commercially available, non-electric, long-period delay blasting cap 34. After electric initiation of one explosive assembly 28, each subsequent assembly is detonated pyrotechnically after a one second or longer delay.

We claim:

1. In combination with a steam boiler including at least one bank of a plurality of spaced apart boiler tubing panels, each panel including multiple spaced apart lengths of boiler tubing, an apparatus for deslagging said boiler with an explosive blastwave and kinetic energy, comprising, a plurality of loop clusters of detonating cord, each loop cluster including a plurality of loops of detonating cord arranged in a multi-directional pattern to impart a three-dimensional shape to said cluster, said plurality of loop clusters being supported in spaced apart relation between adjacent tubing panels, and lengths of detonating cord interconnecting said plurality of loop clusters to form a first explosive assembly adapted for substantially simultaneous detonation of the loop clusters thereof.

2. The combination of claim 1 wherein the three-dimensional shape defined by a loop cluster is generally a spheroid.

3. The combination of claim 2 wherein said plurality of loop clusters are integral parts of a single length of detonating cord.

4. The combination of claim 3 wherein said plurality of loop clusters are connected in series by said lengths of detonating cord.

5. The combination of claim 4 wherein said loop clusters are formed of low grain detonating cord.

6. The combination of claim 5 wherein each loop cluster includes between six and twelve loops of detonating cord.

7. The combination of claim 1 wherein said boiler tubing panels are substantially planer and said plurality of loop clusters are spaced apart both longitudinally and transversely relative to the plane of an adjacent panel.

8. The combination of claim 1 further comprising means for detonating said first explosive assembly from a remote location.

9. The combination of claim 1 further comprising a second explosive assembly of interconnected loop clusters, and means interconnecting said first and second explosive assemblies and operative to pyrotechnically detonate said second explosive assembly after a predetermined delay in response to detonation of first explosive assembly.

10. A method for deslagging a steam boiler including at least one bank of a plurality of spaced apart boiler tubing panels, each panel including multiple spaced apart lengths of boiler tubing, said method comprising, providing a plurality of loop clusters of detonating cord, each loop cluster including a plurality of loops of detonating cord arranged in a multi-directional pattern to impart a three-dimensional shape to said clusters, interconnecting said plurality of loop clusters to form a first explosive assembly adapted for substantially simultaneous detonation of a plurality the loop clusters thereof, placing said plurality of loop clusters in spaced apart relation between adjacent tubing panels, and detonating said first explosive assembly.

11. The method of claim 10 wherein providing a plurality of loop clusters comprises forming said plurality of loop clusters from a single length of detonating cord.

12. The method of claim 10 wherein providing a plurality of loop clusters comprises forming each loop cluster from a length of detonating cord.

13. The method of claim 12 wherein forming each loop cluster comprises forming said length of detonating cord into a plurality of loops and generally arranging said loops around a common center to impart a generally spheroid shape to said cluster.

14. The method of claim 13 wherein forming each loop cluster further comprises using low grain detonating cord.

15. The method of claim 13 wherein forming each loop cluster further comprises forming between six and twelve loops of detonating cord.

16. The method of claim 15 wherein forming each loop cluster further comprises arranging said loops in generally uniformly spaced apart relation about the periphery of said cluster.

17. The method of claim 10 further comprising, forming a plurality of explosive assemblies, each adapted for substantially simultaneous detonation of a plurality of loop clusters thereof, and arranging the loop clusters of each explosive assembly in spaced apart relation between a respective pair of adjacent tubing panels.

18. The method of claim 17 wherein said plurality of spaced apart boiler tubing panels define spreads therebetween, and further comprising placing said explosive assemblies in every second, third, or fourth spread.

* * * * *